US006956493B1

(12) United States Patent
Youngblood

(10) Patent No.: US 6,956,493 B1
(45) Date of Patent: Oct. 18, 2005

(54) PORTABLE SENSING LIGHT

(76) Inventor: Tena Youngblood, 13653 Mays Canyon Rd., Guerneville, CA (US) 95446

( * ) Notice: Subject to any disclaimer, the term of this patent is extended or adjusted under 35 U.S.C. 154(b) by 147 days.

(21) Appl. No.: 10/077,425

(22) Filed: Feb. 15, 2002

(51) Int. Cl.[7] ..... G08B 23/00

(52) U.S. Cl. ..... 340/693.9; 340/565; 340/567; 362/101; 362/276; 439/280; 439/449; 277/312; 277/345

(58) Field of Search ..... 340/567; 362/276, 362/101; 439/278, 280, 449, 464, 471, 474, 439/527, 538, 611, 869; 277/312, 345

(56) References Cited

U.S. PATENT DOCUMENTS 4,692,848 A * 9/1987 Poyer ..... 362/216
4,890,318 A * 12/1989 Crane et al. ..... 379/413.02
4,943,799 A * 7/1990 Papineau ..... 340/521
5,015,994 A * 5/1991 Hoberman et al. ..... 340/567
5,155,474 A * 10/1992 Park et al. ..... 340/691
5,167,445 A * 12/1992 Linnenkamp et al. ..... 362/101
5,299,971 A * 4/1994 Hart ..... 446/484
5,371,489 A * 12/1994 Carroll et al. ..... 340/565
5,442,532 A * 8/1995 Boulos et al. ..... 362/276
5,463,595 A * 10/1995 Rodhall et al. ..... 367/93
5,489,891 A * 2/1996 Diong et al. ..... 340/567
5,575,557 A * 11/1996 Huang et al. ..... 362/276
5,649,761 A 7/1997 Sandell et al. ..... 362/276
5,691,603 A * 11/1997 Nilssen ..... 315/209 R
5,818,338 A * 10/1998 Ferraro ..... 340/568.1
5,831,391 A * 11/1998 MacKay ..... 315/159
5,867,099 A 2/1999 Keeter ..... 340/567
6,091,200 A 7/2000 Lenz ..... 315/159
6,098,943 A 8/2000 Howard et al. ..... 248/231.81
6,118,375 A 9/2000 Duncan ..... 340/521
6,154,130 A 11/2000 Mondejar et al. ..... 340/521
6,372,186 B1 * 4/2002 Fencl et al. ..... 422/121
6,612,713 B1 * 9/2003 Kuelbs ..... 362/102

* cited by examiner

*Primary Examiner*—Benjamin C. Lee

(57) ABSTRACT

A motion-sensing light includes a power cord with a plug to be plugged into an electrical outlet. In one embodiment, the light is moisture-resistant, allowing the light to be used outdoors with a suitable electrical outlet. The light may be mounted on a wall with nails or screws, hung from a hook, or a mounting bracket that holds the lamp in a desired orientation, yet allows removal and re-insertion of the light.

12 Claims, 3 Drawing Sheets

PORTABLE SENSING LIGHT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

The present invention relates generally to a light that turn on in response to a signal from a detector, and more particularly to movable or portable motion-sensing lights that can be plugged into a standard electrical outlet.

Motion-sensing lights are used in a variety of ways to increase the safety, security, and convenience of one's home. A porch light that automatically comes on when someone approaches the porch, or a floodlight that automatically comes on when someone is in the driveway are examples of uses of these types of lights. These types of light often use a passive infra-red ("PIR") detector to sense motion of an object, turn on the light for a pre-selected period of time, and then turn the light off. Often, the lights are also provided with a photo-detector to prevent the light from turning on in daylight. Many such lights have adjustable sensitivity, and an override switch for testing or standard switched operation.

Unfortunately, such lamps are permanently wired into a standard 4-inch octagonal electrical box. The lamp is often sold with the mounting hardware, including a gasket to seal the lamp, if the lamp is to be used outdoors. The gasket is typically a thin piece of rubber or foam rubber, and the mounted light might leak if the gasket is not properly aligned when it is installed; however, the standard electrical boxes typically have punch-outs for wire entries that can leak water. Therefore, the boxes are intended to be installed inside or behind a wall. Similarly, if a utility box is not already where the light is desired, the wiring and box must be installed. Even hooking up the lamp to existing wiring might be more than a homeowner might want to attempt, and professional assistance is often hired, adding to the cost of installing such a light.

Some motion-sensing lights use batteries to power the lamps and the sensing circuit. Unfortunately, batteries run out of power eventually, and the light may fail unless the batteries are replaced in time. This can add to the cost of operation and unreliable operation. Similarly, a compromise is often made between the light output and draw on the battery power.

BRIEF SUMMARY OF THE INVENTION

The present invention provides a more convenient, lower total cost motion-sensing light that is portable from one location to another and does not require permanent installation. In one embodiment, a portable motion-sensing light includes a housing, a sensor mounted on the housing and electrically coupled to a control circuit coupled to a lamp socket configured to accept a light bulb; and a power cord with an electrical plug on an end of the power cord, the power cord being configured to provide electrical power to the motion-sensing light when the electrical plug is plugged into an electrical socket.

In a particular embodiment, the housing is a watertight outdoor outlet box, allowing the portable motion-sensing light to be mounted outdoors. The wire entry points can be sealed with foam to enhance moisture-resistance. In a further embodiment, a mounting member is provided on the back of the housing to allow convenient removal and mounting of the light.

DETAILED DESCRIPTION OF THE INVENTION

The present invention provides a portable motion-sensing light with a power cord that can be plugged into a standard electrical outlet. The light can then be moved about within the range of the power cord, or can be moved and plugged into a different electrical outlet. In a particular embodiment, the body of the lamp and the power cord are moisture-resistant for outdoor applications.

The lamp may be advantageously used in a variety of applications, such as renters who do not want to or cannot install a fixed motion sensing light at their residence. It may be used by campers, if an electrical outlet is available, to provide an automatic ground light, or by recreational vehicle enthusiasts who want to mount a motion sensing light when parked, and remove it when traveling. It can be used as an in-home security device when people are away from home, automatically lighting a room if an intruder enters. Similarly, it can be used by travelers for security in motel rooms, or to automatically turn on if someone approaches the travelers vehicle.

Figure 1A:
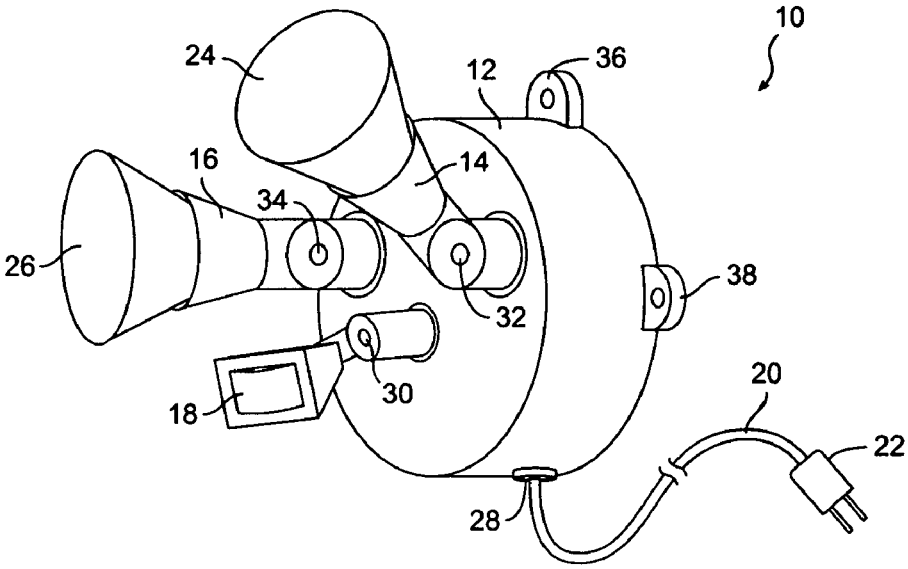
FIG. 1A is a simplified perspective view of a portable motion-sensing light according to an embodiment of the present invention.

FIG. 1A is a simplified perspective view of a portable sensing light 10 according to an embodiment of the present invention. The light includes a housing 12, lamp sockets 14, 16, a sensor 18, and a power cord 20 with a plug 22 on the end of the power cord to be plugged into an electrical socket. In a particular embodiment the plug is a 3-prong plug for a grounded 115V AC electrical socket, but other voltages and types of plugs are possible. For example, the plug might be configured for a 2-prong socket of the same or different voltage, or a low-voltage DC socket.

The sensor 18 is typically a PIR sensor. Such sensors are commonly used on fixed motion-sensing lights. Two lamp sockets 14, 16 are illustrated, but lights according to embodiments of the invention may have a single socket or additional light sockets. Light bulbs 24, 26 are shown in the lamp sockets 14, 16 for purposes of illustration only, and are not limiting of the invention, since a portable motion-sensing light might be sold with or without the light bulbs. The light bulbs might be flood lamps, spot lights, compact fluorescent bulbs, or other types of light bulb(s). The type of light bulb(s) is typically matched to the type of electrical power that the light will be plugged into.

The power cord 20 is an outdoor-rated 3-wire cable, and in a particular embodiment is orange to provide high visibility of the cord. The power cord enters the housing 12 at a fitting 28, which is also rated for outdoor use and generally provides a weather-resistant seal as well as strain relief. It is generally desirable that the power cord be at least eight feet long to facilitate mounting the light above eye level while plugging the power cord into an electrical outlet, which is typically one to three feet off the ground.

The sensor 18, and lamp sockets 14, 16 are typically mounted with adjustment mechanisms 30, 32, 34. The adjustment mechanisms can be ball-and-socket joints, swivels with lock rings, and/or toothed clamping plates, for example. The light is typically mounted to a wall or other support, using screws, nails, or a hook, for example. In a particular embodiment mounting holes 36, 38 are provided. Another mounting hole on the side of the light opposite the mounting hole 38 is not shown in this view. The light can be hung from a hook through the top mounting hole 36, or the light can be mounted with nails or screws through the side and/or top mounting hole. Using screws to secure the light to a wall is not considered a "permanent" installation for purposes of this disclosure because the screws or nails are relatively easy to remove in order to move the light, which does not require hooking up the lamp to fixed wiring within a utility box.

In a particular embodiment, a bracket is provided to be mounted on a wall, tree, post, or other support. The light is provided with a mating portion that couples the light to the bracket, thus holding the light in a selected orientation. The bracket allows the light to be quickly and easily removed and installed.

For example, the bracket might be mounted on the side of a recreational vehicle ("RV") and installed when the RV is being set up, and removed when the RV is being prepared to be moved. The motion sensing light can be powered from the AC power hook-up at the RV site, or run off a generator, for example. The light provides a convenient automatic light for users, and can also enhance security by alerting the occupants of the RV of the approach of a human or animal. The light can also be used primarily as a security device. In one application, the light is mounted to oversee a trailer with a boat, jet skis, motorcycles, or other equipment, either at a storage location or at a location of use. The automatic operation of the light can signal the approach of unauthorized personnel to the owner or watchperson present or in the vicinity.

Figure 1B:
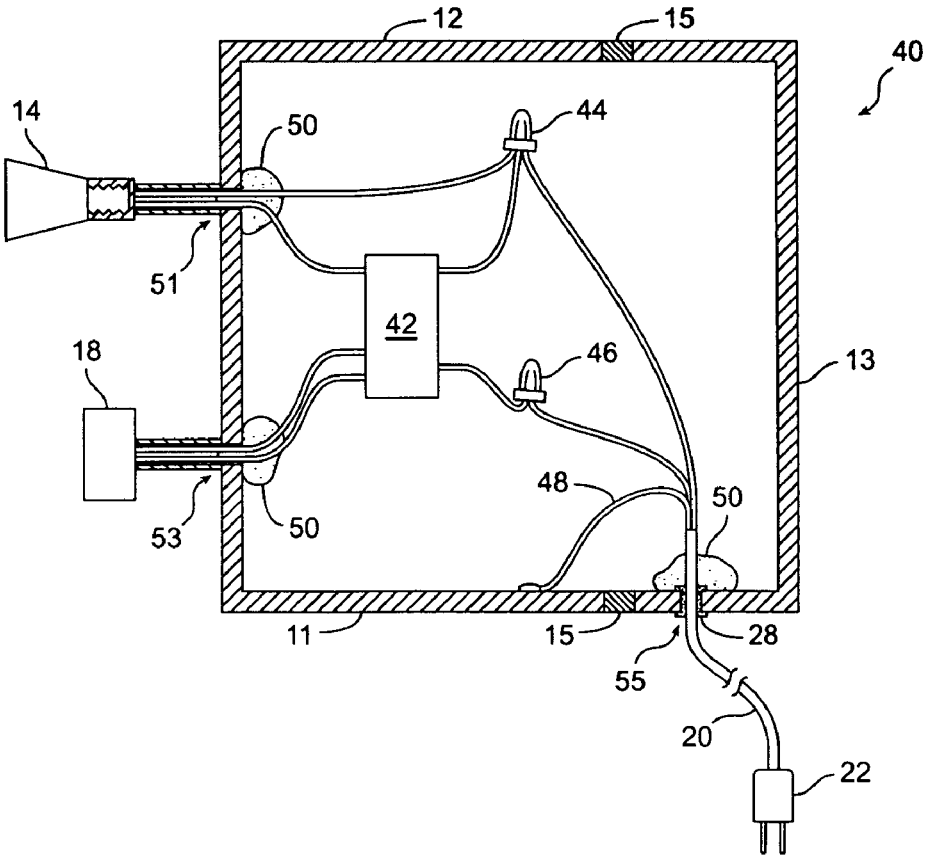
FIG. 1B is a simplified diagram of a portable motion-sensing light according to an embodiment of the present invention.

FIG. 1B is a simplified diagram 40 of a motion sensing light according to an embodiment of the present invention. The light includes a sensor 18 electrically coupled to a control circuit 42. Such control circuits are well known in the art and many such circuits can be found in conventional fixed motion-sensing lights. The control circuit controls the power to a lamp socket 14, and lights a lamp (not shown) when an activation signal is received from the sensor. Several configurations of wiring are possible for various control circuits and sensors.

Power to the motion-sensing light is provided through a power cord 20 with an electrical plug 22 on the end. The power cord brings power into the housing 12 through a water-resistant fitting 28. In a particular embodiment, the housing 12 is metal and seals the control circuit and electrical connections 44, 46 from the weather, allowing outdoor use of the portable motion-sensing light. One type of housing is known as a watertight fixture box, which are typically made of cast aluminum, zinc-dipped iron, or bronze, and have thread entries to keep out water. An example is the model RB-5AV™ available from BWF MANUFACTURING, INC., of Cudahy, Calif. Alternatively, the housing could be drawn aluminum or steel, with galvanizing or other coating to resist corrosion, plastic, composite or other material. Similarly, although a general fixture box is illustrated, a specialized housing with the appropriate power cord entry point and mounting features could be used. The light and sensor are typically also listed by UNDERWRITERS LABORATORIES ("UL Listed") for wet location use.

A ground wire 48 attaches to the housing. Ground connections of other components of the light are not shown for simplicity of illustration. Use of a metal, metalized, conductive composite, or other conductive housing allows grounding of other components, such as the outer portions of the lamp sockets, through the housing. In an alternative embodiment the housing is not conductive and the ground wire is wired to the control circuit and other components. In yet another embodiment, the power cord is a 2-wire cord, and the ground wire is omitted.

The housing may comprise two portions 11, 13 sealed with a gasket and screws at the factory, eliminating the need for the user to align and install the gasket, or may be essentially permanently sealed by welding the housing shut after assembly, or by using an adhesive sealant 15, such as room-temperature vulcanizing ("RTV") compound. The housing can be assembled as a can with a back cover plate, a can with a front piece, or shell halves, for example. In a particular embodiment the housing or a portion of the housing is filled with expanding closed-cell foam 50, such as polyurethane foam sealant, to further seal the housing interior. Such foam can be applied at the wire entry points, namely the lamp socket(s) wire entry 51, sensor wire entry 53, and power cord entry 55, to provide an additional seal against moisture. The compliant foam allows minor adjustment of the sensor and lamp sockets while maintaining a seal. Similarly, the compliant foam at the entry point of the power cord provides an enhanced seal as the power cord is pulled or otherwise stressed.

Figure 1C:
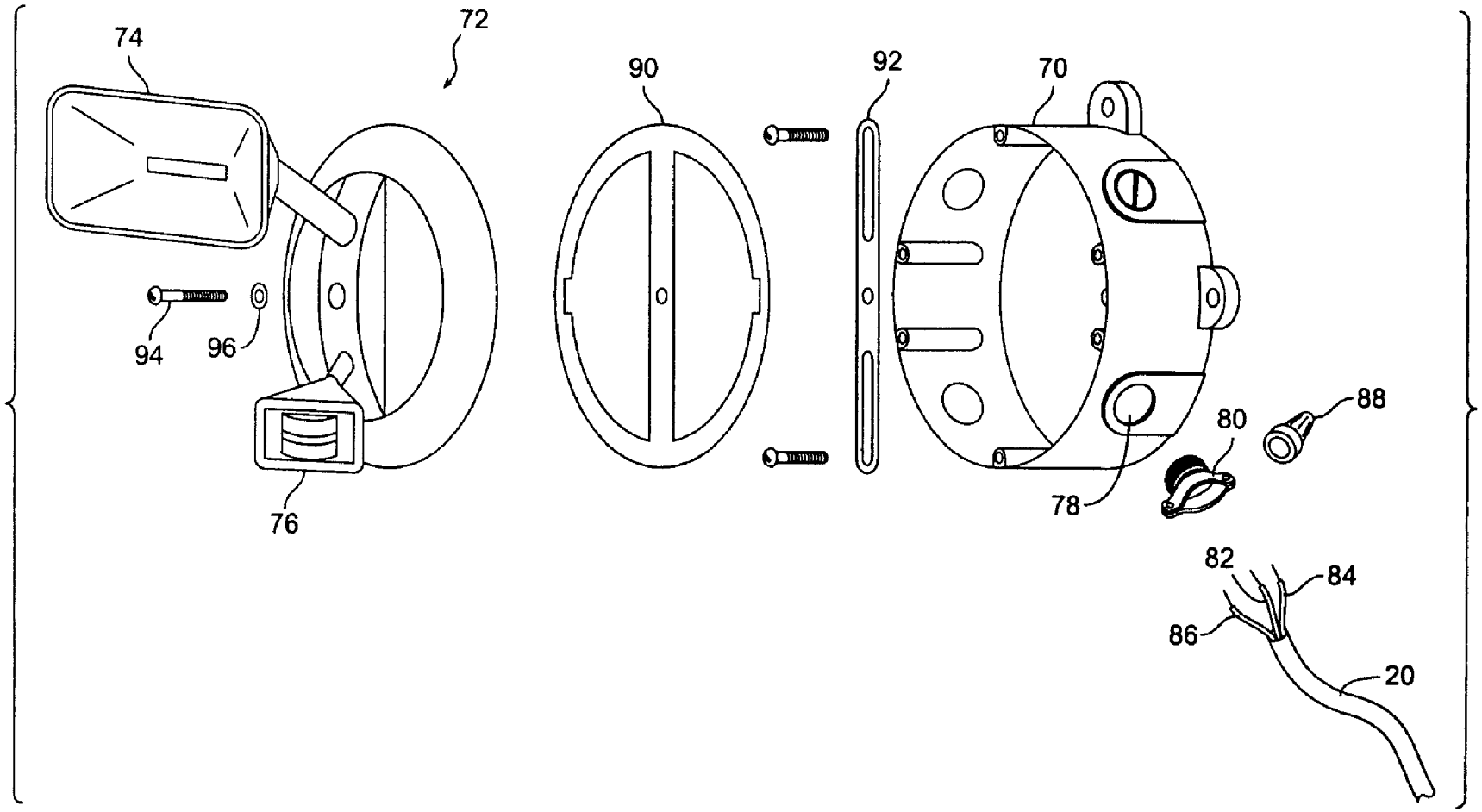
FIG. 1C is a simplified exploded perspective view of component parts of a portable motion-sensing light according to an embodiment of the present invention.

FIG. 1C is a simplified exploded perspective view of components of a motion-sensing light according to an embodiment of the present invention. A watertight fixture box 70 is coupled to an outdoor light assembly 72. The outdoor light assembly includes a lamp 74, which in a particular embodiment is a halogen lamp, and a sensor head 76 that is also designed for use in outdoor or wet locations. The fixture box has a threaded entry 78 for bringing electrical power from the electrical cord 20 into the box. A loom clamp 80 holds the electrical cord and is screwed into the threaded entry. Sealant, such as silicone-based sealant, may be used to further seal the cord entry by application to the clamping region before tightening the clamp.

The electrical cord is typically orange, yellow, white, or other high-visibility color to enhance safety, and is typically a 3-wire cord with hot, neutral, and ground wires 82, 84, 86. The wires are connected to the light assembly wiring (not shown) with connectors 88 (only one of which is shown), such as wire nuts or crimp-on connectors. In a particular embodiment, the connectors are model 62110™ available from KING SAFETY PRODUCTS, and include a waterproof safety seal.

A gasket 90 between the light assembly 72 and the fixture box 70 forms a watertight seal between the two when the light assembly is attached to the fixture box. A butterfly 92 is attached to the fixture box, allowing the light assembly to be mounted with a center screw 94 and a washer 96 that seals the assembly. Alternative or further sealing can be provided, or a light assembly can be adhesively attached to a fixture box with sealant.

Figure 2:
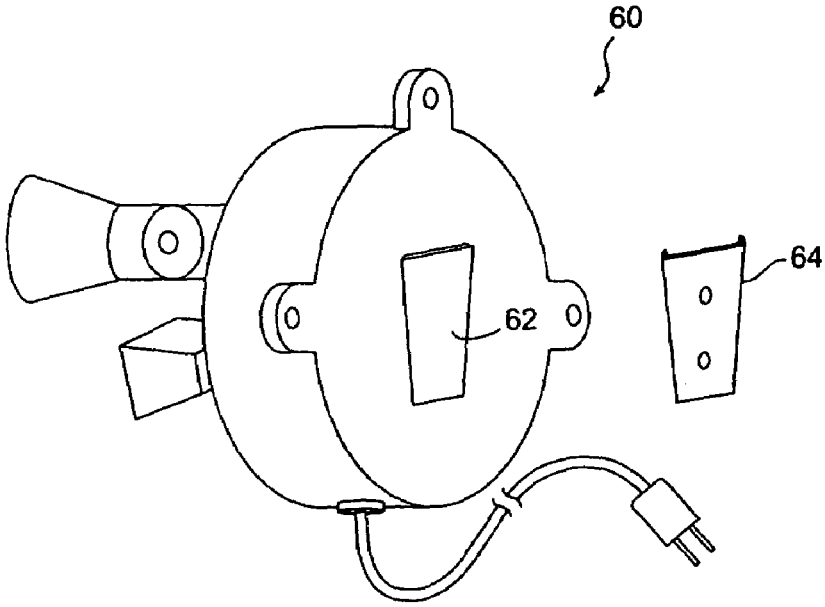
FIG. 2 is a simplified perspective view of a back portion of a portable motion-sensing light and mounting bracket according to an embodiment of the present

FIG. 2 is a simplified perspective view of the back of a motion-sensing light 60 according to an embodiment of the present invention with a mounting member 62. A mounting bracket 64 is configured to accept the mounting member on the back of the light. The user can mount a number of brackets and move a single light between them, with or without unplugging and moving the power cord plug. The bracket 64 is typically mounted to a support structure with screws or other fasteners, but a bracket could be integrated into a structure for use with the portable motion-sensing light. Alternatively, the light could have a mounting member that is the exterior portion ("shoe") of mounting means, while the bracket is the interior portion ("foot"). Many other configurations of mounting means are possible. It is generally desirable that the mounting bracket be able to hold the light at a selected degree of rotation from the vertical.

Figure 3:
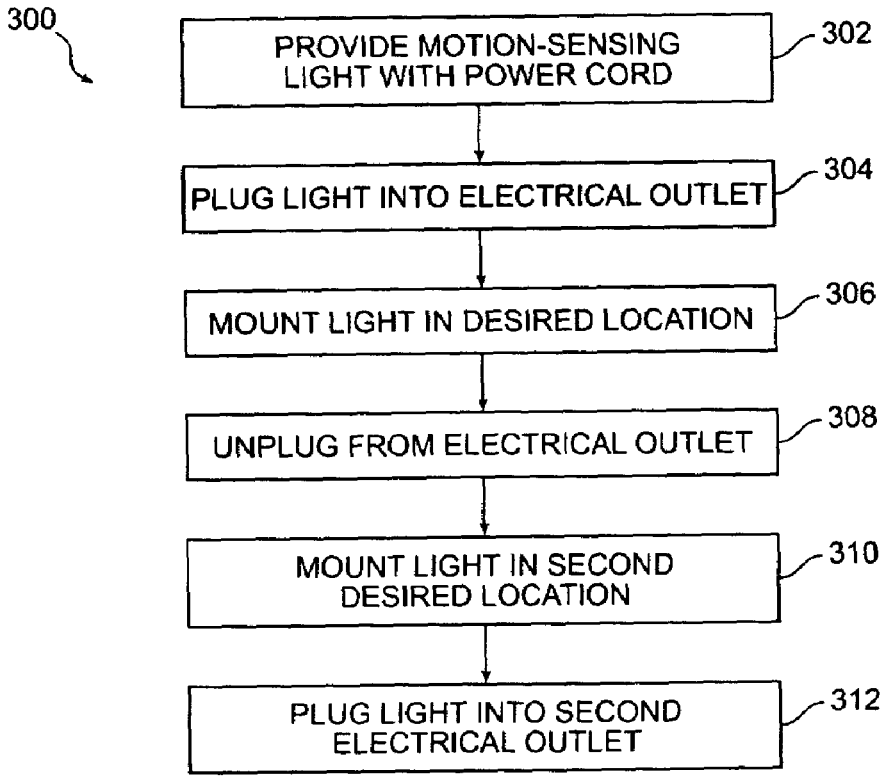
FIG. 3 is a simplified flow chart of a method of operating a portable motion-sensing light according to an embodiment of the present invention.

FIG. 3 is a simplified flow chart of a method of operating a motion-sensing light 300 according to an embodiment of the present invention. A portable motion-sensing lamp with a power cord and electrical plug is provided (step 302). The portable motion-sensing lamp is plugged into an electrical outlet (step 304) and mounted in a desired location (step 306). The latter steps may be performed in reverse order. The desired location is generally within the length of the power cord from the electrical outlet, but may be extended with an extension cord in some applications. In a further embodiment, the portable motion-sensing lamp is removed from the first location (step not shown) and mounted in a second desired location (step 310). In a yet further embodiment, the portable motion-sensing light is unplugged from the electrical outlet (step 308) before being moved and plugged into a second electrical outlet (step 312), either before or after mounting in the second location.

In an alternative embodiment, the portable motion-sensing light is unplugged from the electrical outlet, and removed (step not shown) from the desired location, and then is remounted in the desired location and plugged back in to the electrical outlet or another electrical outlet. Such a process is described above in relation to an RV that might have a fixed mounting bracket that the light is mounted in when the RV is parked and removed from when the RV is being moved. The light could plug into an electrical outlet on the RV, or plug into different electrical outlets at the campsites.

While embodiments of the invention have been described and illustrated above, substitutions, modifications, and equivalents may be apparent, or may become apparent, to those skilled in the art without departing from the spirit of the invention. For example, specific embodiments have been described using a PIR sensor, but other types of sensors might be used. Therefore, the specific embodiments described and illustrated are not limiting of the invention, which is defined by the following claims.

What is claimed is:

1. A portable motion-sensing light comprising:

a sealed housing;

a sensor adjustably mounted on the sealed housing and electrically coupled to a control circuit inside the sealed housing coupled to a lamp socket adjustably mounted on the sealed housing configured to accept a light bulb, the sensor being separately adjustable from the lamp socket; and a power cord having an electrical plug on a first end of the power cord and entering the sealed housing at a power cord entry securing the power cord to the sealed housing, a second end of the power cord being connected to electrical connections within the sealed housing, the power cord entry cooperating with the electrical connections within the sealed housing so as to provide a weather-resistant seal and strain relief allowing outdoor motion-sensing illumination; and further comprising expanding closed-cell foam applied within the sealed housing around at least one of the power cord entry, a sensor wire entry, and a lamp socket wire entry.

2. The portable motion-sensing light of claim 1 wherein the sealed housing includes a first housing portion, a second housing portion, and a watertight gasket disposed between the first housing portion and the second housing portion.

3. The portable motion-sensing light of claim 1 wherein the sealed housing comprises a first housing portion and a second housing portion, the first housing portion being welded to the second housing portion.

4. The portable motion-sensing light of claim 1 wherein the sealed housing comprises a first housing portion and a second housing portion, the first housing portion being sealed to the second housing portion with an adhesive sealant.

5. The portable motion-sensing light of claim 1 further comprising means for mounting the portable sensing light on a support structure.

6. The portable motion-sensing light of claim 5 wherein the means for mounting includes a mounting member on a back of the sealed housing configured to removably couple to a mating mounting bracket disposed on an outdoor support structure so as to facilitate mounting the portable motion-sensing light in a selected outdoor location, and then to facilitate removing the portable motion-sensing light from the selected outdoor location.

7. A weather-resistant portable motion-sensing light for comprising:

a watertight housing with a back;

a sensor adjustably mounted on the housing and electrically coupled to a control circuit coupled to a lamp socket adjustably mounted on the sealed housing configured to accept a light bulb, the sensor being separately adjustable from the lamp socket;

a power cord having an electrical plug on a first end of the power cord, the power cord entering the watertight housing at a power cord entry securing the power cord to the sealed housing, a second end of the power cord being connected to electrical connections within the sealed housing so as to provide electrical power to the weather-resistant portable motion-sensing light when the electrical plug is plugged into an electrical socket;

means for mounting the weather-resistant portable motion-sensing light on an outdoor support structure; and expanding closed-cell foam applied within the watertight housing around at least one of a power cord entry, a sensor wire entry, and a lamp socket wire entry.

8. The weather-resistant portable motion-sensing light of claim 7 wherein the means for mounting is a mounting member located on the back of the watertight housing configured to couple to a mating mounting bracket disposed on an outdoor support structure so as to facilitate mounting the portable motion-sensing light in a selected outdoor location, and then to facilitate removing the portable motion-sensing light from the selected outdoor location.

9. A method of operating a weather-resistant portable motion-sensing light of claim 7, the method comprising:

providing the motion-sensing light with the integrated power cord extending into a weather-resistant housing of the motion-sensing light and the electrical plug on the first end of the integrated power cord;

mounting the motion-sensing light at on a first outdoor support structure; and plugging the electrical plug of the integrated power cord into an electrical outlet.

10. The method of claim 9 further comprising steps of:

removing the motion-sensing light from the first outdoor support structure; and mounting the motion-sensing light on a second outdoor support structure.

11. The method of claim 9 further comprising steps of:

unplugging the electrical plug from the electrical outlet; and plugging the electrical plug into a second electrical outlet.

12. The method of claim 9 further comprising steps of:

unplugging the electrical plug from the electrical outlet;

removing the motion-sensing light from the first outdoor support structure;

mounting the motion-sensing light on a second outdoor support structure; and plugging the electrical plug into a second electrical outlet.

* * * * *